US009693150B2

(12) United States Patent
Yang et al.

(10) Patent No.: US 9,693,150 B2
(45) Date of Patent: Jun. 27, 2017

(54) MICROPHONE SENSOR

(71) Applicant: Hyundai Motor Company, Seoul (KR)

(72) Inventors: Sang-Hyeok Yang, Gyeonggi-do (KR); Hyunsoo Kim, Seoul (KR); Sang Gyu Park, Seoul (KR); Ilseon Yoo, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/847,776

(22) Filed: Sep. 8, 2015

(65) Prior Publication Data

US 2016/0142828 A1 May 19, 2016

(30) Foreign Application Priority Data

Nov. 17, 2014 (KR) ..... 10-2014-0160336

(51) Int. Cl.
*H04R 17/02* (2006.01)

(52) U.S. Cl.
CPC ..... *H04R 17/02* (2013.01); *H04R 2201/003* (2013.01); *H04R 2410/03* (2013.01)

(58) Field of Classification Search
CPC ..... H04R 2201/003; H04R 17/02; H04R 2410/03; H04R 19/016
See application file for complete search history.

(56) References Cited

U.S. PATENT DOCUMENTS 4,751,418 A * 6/1988 Murase ..... H04R 17/02 310/319
7,301,212 B1 * 11/2007 Mian ..... H04R 19/016 257/415
8,270,634 B2 9/2012 Harney et al.
2009/0130783 A1 * 5/2009 Miyashita ..... H04R 19/005 438/10

FOREIGN PATENT DOCUMENTS

JP 2001-025095 A 1/2001
JP 2002-095091 A 3/2002
(Continued)

*Primary Examiner* — Md S Elahee
*Assistant Examiner* — Angelica M McKinney
(74) *Attorney, Agent, or Firm* — Mintz Levin Cohn Ferris Glovsky and Popeo, P.C.; Peter F. Corless

(57) ABSTRACT

A microphone, that increases sensitivity without a separate circuit is provided. The microphone includes an audio detection module having a vibration film that outputs capacitance signals by vibrating audio introduced from the exterior and a piezoresistive element that outputs a piezoresistive signal by a sound pressure of the audio. A semiconductor chip includes an amplifier electrically connected to the audio detection module to receive a capacitance signal and a piezoresistive signal from the audio detection module and amplifies the capacitance signal and piezoresistive signal to an electrical signal. The amplifier includes an input terminal that receives an input of the capacitance signal; a first resistor connected to the input terminal and the piezoresistive element; an output terminal that amplifies and outputs the capacitance signal and piezoresistive signal to an electrical signal; and a second resistor connected to the input terminal and the output terminal and connected to the piezoresistive element.

13 Claims, 5 Drawing Sheets

(56) References Cited

FOREIGN PATENT DOCUMENTS

| | | | | |
|---|---|---|---|---|
| JP | 2002-095092 | A | | 3/2002 |
| JP | 2007-096364 | A | | 4/2007 |
| JP | 2008-256433 | A | | 10/2008 |
| JP | 2009-100177 | A | | 5/2009 |
| JP | 2009100177 | A | * | 5/2009 |

* cited by examiner

MICROPHONE SENSOR

CROSS-REFERENCE TO RELATED APPLICATION

This application claims priority to and the benefit of Korean Patent Application No. 10-2014-0160336 filed in the Korean Intellectual Property Office on Nov. 17, 2014, the entire contents of which are incorporated herein by reference.

BACKGROUND (a) Field of the Invention

The present invention relates to a microphone and more particularly, to a microphone that improves sensitivity without adding a separate circuit.

(b) Description of the Related Art

In general, a microphone is a device that converts audio to an electrical signal. A microphone should improve electromagnetic and audio performance, reliability, and operability. Additionally, a microphone is gradually formed to have a reduced size. Accordingly, a microphone using Micro Electro Mechanical System (MEMS) technology has been developed.

The MEMS microphone has a tolerance against moisture and heat, compared with a conventional Electret Condenser Microphone (ECM), and can be reduced in size and be integrated into a signal processing circuit. In general, a MEMS microphone may be classified into a piezoelectric MEMS microphone and a capacitive MEMS microphone.

The piezoelectric MEMS microphone is formed with a vibration film, and when the vibration film is changed by external audio, an electrical signal occurs due to a piezoelectric effect and thus a sound pressure is measured. The capacitive MEMS microphone includes a fixed electrode and a vibration film, and when audio is applied from the exterior to the vibration film, while a gap between the fixed electrode and the vibration film is changed, a capacitance value is changed. A sound pressure is measured based on an electrical signal occurring during the process.

However, because a vibration displacement of a film is limited, the method of increased sensitivity is limited. Accordingly, a method of increasing strength by simultaneously outputting and adding a signal of another form is introduced. For example, in conventional methods, a signal processing circuit is required for each of two output signals, when an additional circuit that adds signals is required. Accordingly, a semiconductor chip area increases resulting in price increases and a power consumption increase.

The above information disclosed in this section is merely for enhancement of understanding of the background of the invention and therefore it may contain information that does not form the prior art that is already known in this country to a person of ordinary skill in the art.

SUMMARY

The present invention provides a microphone having improved sensitivity and may reflect a change of resistance to an amplifying rate by connecting a piezoresistive element of an audio detection module to a semiconductor chip.

An exemplary embodiment of the present invention provides a microphone that may include: an audio detection module having a vibration film that may output a capacitance signal by vibrating by audio introduced from the exterior and a piezoresistive element that may output a piezoresistive signal by a sound pressure of the audio; and a semiconductor chip having an amplifier electrically connected to the audio detection module to receive a capacitance signal and a piezoresistive signal from the audio detection module and configured to amplify the capacitance signal and piezoresistive signal to an electrical signal. The amplifier may include: an input terminal configured to receive an input of the capacitance signal; a first resistor connected to the input terminal and connected to the piezoresistive element; an output terminal configured to amplify and output the capacitance signal and piezoresistive signal to an electrical signal; and a second resistor connected to the input terminal and the output terminal and connected to the piezoresistive element.

The audio detection module may further include: first and second pads connected to the piezoresistive element; and an output pad configured to output the capacitance signal to the semiconductor chip. Additionally, the first pad may be connected to the first resistor, and the second pad may be connected to the second resistor. Furthermore, the piezoresistive element may be changed based on the sound pressure and may be connected to the first and second resistors via the first and second pads, respectively.

The input terminal may include: a non-inverting input terminal connected to the output pad that may output the capacitance signal; and an inverting input terminal connected to the first and second resistors and the piezoresistive element. The input terminal may include: a non-inverting input terminal connected to the ground; and an inverting input terminal connected to an output pad that may output the capacitance signal, the first and second resistors, and the piezoresistive element. The amplifier may be an inverting amplifier or a non-inverting amplifier.

Another exemplary embodiment of the present invention provides a microphone which may include: an audio detection module configured to output a capacitance signal which may change by a vibration film that vibrates by audio introduced from the exterior and a fixed electrode and a piezoresistive signal occurring when a sound pressure is applied to a piezoresistive element by the audio. The microphone may further include a semiconductor chip having an amplifier configured to receive the capacitance signal and the piezoresistive signal and amplify the capacitance signal and the piezoresistive signal to an electrical signal. The amplifier may include: a non-inverting input terminal configured to receive an input of the capacitance signal; an inverting input terminal configured to receive an input of the piezoresistive signal connected to the first and second resistors. The amplifier may further include an output terminal configured to amplify and output the capacitance signal and the piezoresistive signal to an electrical signal.

In another exemplary embodiment a microphone may include: an audio detection module having a vibration film that may output a capacitance signal by vibrating by audio introduced from the exterior and a piezoresistive element that may output a piezoresistive signal by the audio. The microphone may further include a semiconductor chip including an amplifier electrically connected to the audio detection module to receive a capacitance signal and a piezoresistive signal from the audio detection module configured to amplify the capacitance signal and the piezoresistive signal to an electrical signal. The amplifier may further include: a non-inverting input terminal connected to the ground; an inverting input terminal configured to receive an input of the capacitance signal; a first resistor connected to the inverting input terminal and connected to the piezoresistive element; a second resistor connected to the inverting input terminal and connected to the piezoresistive element; and an output terminal connected to the second resistor and configured to amplify and output the capacitance signal to an electrical signal based on the piezoresistive element, the first resistor, and the second resistor.

BRIEF DESCRIPTION OF THE DRAWINGS

The above and other objects, features and advantages of the present disclosure will be more apparent from the following detailed description taken in conjunction with the accompanying drawings.

DESCRIPTION OF SYMBOLS

Figure 1:
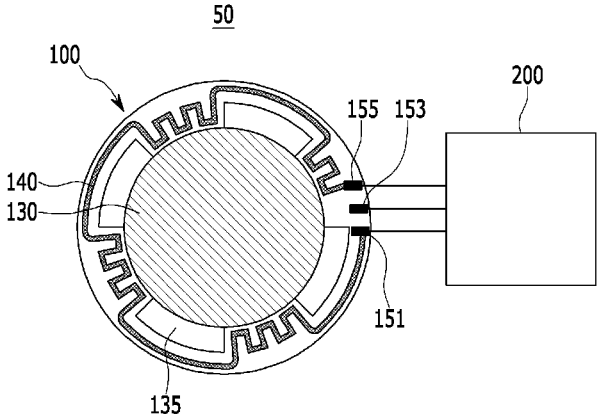
FIG. 1 is an exemplary diagram illustrating a microphone according to an exemplary embodiment of the present invention.

50: microphone
100: audio detection module
110: substrate
130: vibration film
140: piezoresistive element
151, 155: pad
153: output pad
160: support layer
170: fixed electrode
200: semiconductor chip
210: non-inverting amplifier
220, 420: input terminal
240, 250, 440, 450: resistor
260, 470: output terminal
410: inverting amplifier

DETAILED DESCRIPTION OF THE EMBODIMENTS

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, In order to make the description of the present invention clear, unrelated parts are not shown and, the thicknesses of layers and regions are exaggerated for clarity. Further, when it is stated that a layer is "on" another layer or substrate, the layer may be directly on another layer or substrate or a third layer may be disposed therebetween.

An exemplary embodiment of the present invention will hereinafter be described in detail with reference to the accompanying drawings.

Figure 2:
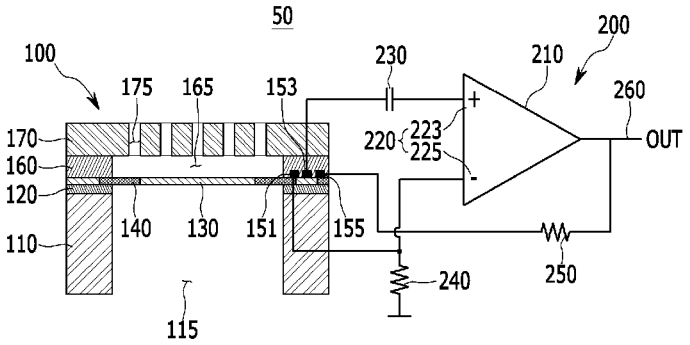
FIG. 2 is an exemplary cross-sectional view illustrating an audio detection module and a circuit diagram illustrating a semiconductor chip according to an exemplary embodiment of the present invention.

FIG. 1 is an exemplary diagram illustrating a microphone according to an exemplary embodiment of the present invention, and FIG. 2 is an exemplary cross-sectional view illustrating an audio detection module and a circuit diagram illustrating a semiconductor chip according to an exemplary embodiment of the present invention.

Referring to FIGS. 1 and 2, a microphone 50 may include an audio detection module 100 and a semiconductor chip 200. The audio detection module 100 may include a substrate 110, a vibration film 130, a piezoresistive element 140, and a fixed electrode 170. The substrate 110 may be formed with silicon, and a penetration aperture 115 may be formed in the substrate 110. An oxide film 120 may be disposed on the substrate 110. In other words, the oxide film 120 may be disposed between the substrate 110 and the vibration film 130. The vibration film 130 may be disposed on the oxide film 120 to cover the penetration aperture 115 that may be formed in the substrate 110. A portion of the vibration film 130 may be exposed by the penetration aperture 115, and the portion of the vibration film 130 exposed by the penetration aperture 115 may vibrate based on audio introduced from the exterior. The vibration film 130 may have substantially a circular shape and may include a plurality of slots 135. The slots 135 may be located on the penetration aperture 115.

Figure 3:
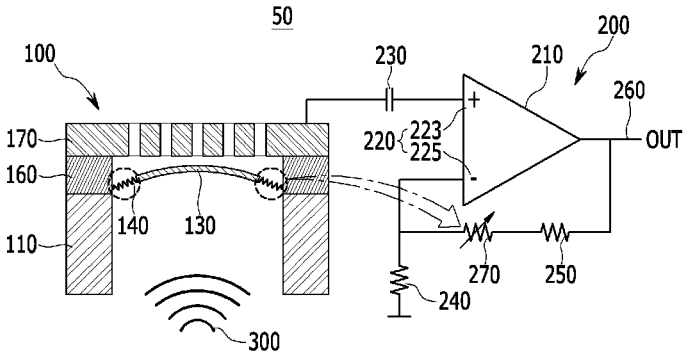
FIG. 3 is an exemplary diagram illustrating a situation in which audio is introduced into a microphone according to an exemplary embodiment of the present invention.

The piezoresistive element 140 may be disposed on the oxide film 120. The piezoresistive element 140 may be connected to a first pad 151 and a second pad 155. As shown in FIG. 3, when a sound pressure is applied by audio 300 introduced from the exterior, the piezoresistive element 140 may be configured to generate a piezoresistive signal. The piezoresistive signal may be output to the semiconductor chip 200 through the first pad 151 and the second pad 155 connected to the piezoresistive element 140. In particular, a piezoresistive signal may be a resistance value.

The first pad 151 and the second pad 155 may be connected to the semiconductor chip 200. The first pad 151 and second pad 155 may be disposed on the piezoresistive element 140. An output pad 153 may be disposed on the vibration film 130 and may be connected to the semiconductor chip 200. A support layer 160 may be disposed at an edge portion of the vibration film 130 and may support the fixed electrode 170. The fixed electrode 170 may be separately disposed from the vibration film 130. Additionally, the fixed electrode 170 may include a plurality of air inlets 175 and may be disposed and fixed on the support layer 160. The fixed electrode 170 may be made of polysilicon or a metal.

An air layer 165 may be formed between the fixed electrode 170 and the vibration film 130. The fixed electrode 170 and the vibration film 130 may be separately disposed with a predetermined gap therebetween. As shown in FIG. 3, the audio 300 from the exterior may be introduced through the air inlet 175 formed in the fixed electrode 170 to stimulate vibration of the vibration film 130 . . . . For example, a gap between the fixed electrode 170 and the vibration film 130 may change and a capacitance signal between the vibration film 130 and the fixed electrode 170 may change. The capacitance signal may be output to the semiconductor chip 200 through the output pad 153 connected to the vibration film 130.

The semiconductor chip 200 may be electrically connected to the audio detection module 100, and may be configured to receive, amplify and output a signal from the audio detection module 100 and detect audio from the exterior. Accordingly, the semiconductor chip 200 may include an amplifier. The amplifier may be a non-inverting amplifier or an inverting amplifier. The non-inverting amplifier may be described with reference to FIGS. 1 to 3, and the inverting amplifier may be described with reference to FIGS. 4 and 5.

The semiconductor chip 200 may be an application specific integrated circuit (ASIC). A non-inverting amplifier 210 may include an input terminal 220, a capacitor 230, a first resistor 240, a second resistor 250, and an output terminal 260. The input terminal 220 may be configured to receive a piezoresistive signal and a capacitance signal from the audio detection module 100. Additionally, the input terminal 220 may include a non-inverting input terminal 223 and an inverting input terminal 225.

The non-inverting input terminal 223 may be connected to the output pad 153 of the audio detection module 100 and may be configured to receive a capacitance signal through the output pad 153. The non-inverting input terminal 223 may be connected to the capacitor 230. One side (e.g., a first side) of the capacitor 230 may be connected to the output pad 153, and the other side of the capacitor 230 may be connected to the non-inverting input terminal 223. The inverting input terminal 225 may be connected to the first resistor 240. One side (e.g., a first side) of the first resistor 240 may be connected to ground, and the other side of the first resistor 240 may be connected to the first pad 151 that may be connected to the piezoresistive element 140.

The second resistor 250 may be connected to the inverting input terminal 225 and the output terminal 260. Additionally, one side (e.g., a first side) of the second resistor 250 may be connected to the second pad 155 that may be connected to the piezoresistive element 140 and may be connected to the inverting input terminal 225 through the second pad 155. The other side (e.g., a second side) of the second resistor 250 may be connected to the output terminal 260.

As shown in FIG. 3, when the audio 300 is introduced from the exterior, the piezoresistive element 140 may be configured to perform a function of a variable resistor 270. In other words, since the piezoresistive element 140 may be connected to the first resistor 240 and the second resistor 250 through the first pad 151 and the second pad 155, the piezoresistive element 140 may exhibit an effect as if it is inserted between the first resistor 240 and the second resistor 250. Accordingly, when the audio 300 is introduced from the exterior, a piezoresistive signal may change to reflect an amplifying rate of the non-inverting amplifier 210. In other words, an amplifying rate may be determined by the first resistor 240, the second resistor 250, and the piezoresistive element 140. For example, an amplifying rate may be determined by Equation 1.

$$\text{Gain} = 1 + \frac{R2 + \Delta R}{R1} \qquad \text{Equation 1}$$

wherein, Gain is an amplifying rate, R1 represents a first resistance value, R2 represents a second resistance value, and ΔR represent a piezoresistive signal. The output terminal 260 may be configured to output an amplified electrical signal.

Figure 4:
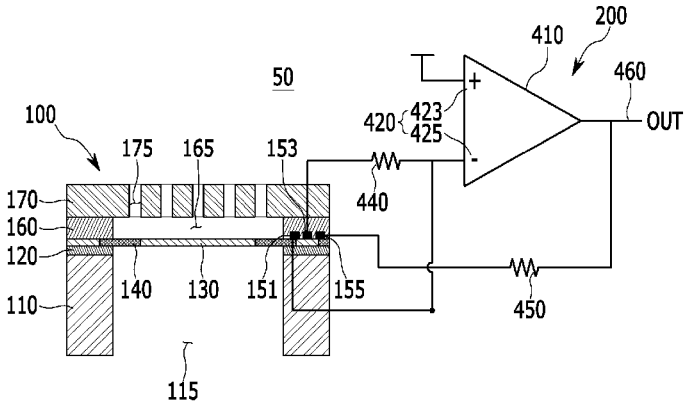
FIG. 4 is an exemplary cross-sectional view illustrating an audio detection module and a circuit diagram illustrating a semiconductor chip according to another exemplary embodiment of the present invention.

FIG. 4 is an exemplary cross-sectional view illustrating an audio detection module 100 and a circuit diagram illustrating a semiconductor chip 200 according to another exemplary embodiment. Referring to FIG. 4, a microphone 50 may include an audio detection module 100 and a semiconductor chip 200. The audio detection module 100 may include a substrate 110, an oxide film 120, a vibration film 130, a piezoresistive element 140, a support layer 160, and a fixed electrode 170. A penetration aperture 115 may be formed in the substrate 110. The oxide film 120 may be disposed on the substrate 110. In other words, the oxide film 120 may be disposed at an edge portion of the audio detection module 100. The vibration film 130 may be disposed on the substrate 110 to cover the penetration aperture 115 formed in the substrate 110.

The piezoresistive element 140 may be disposed on the oxide film 120 and may connect to a first pad 151 and a second pad 155. A piezoresistive signal may be changed in the piezoresistive element 140 by a sound pressure of audio introduced from the exterior. The first pad 151 and the second pad 155 may be disposed on the piezoresistive element 140 and may be connected to the semiconductor chip 200. In other words, the first pad 151 may be connected to an inverting input terminal of the semiconductor chip 200, and the second pad 155 may be connected to a second resistor of the semiconductor chip 200.

An output pad 153 may be disposed on the vibration film 130 and may be connected to the semiconductor chip 200. For example, the output pad 153 may be connected to an inverting input terminal of the semiconductor chip 200. The support layer 160 may be disposed on the vibration film 130. In particular, the support layer 160 may support the fixed electrode 170 and may be disposed at an edge portion of the vibration film 130. The fixed electrode 170 may be formed on the support layer 160 and may be separately disposed from the vibration film 130. The fixed electrode 170 may include a plurality of air inlets 175.

An air layer 165 may be formed between the vibration film 130 and the fixed electrode 170. Audio introduced from the exterior stimulates the vibration film 130 thereby vibrating the vibration film 130 and a capacitance signal between the vibration film 130 and the fixed electrode 170 may be changed. The semiconductor chip 200 may be electrically connected to the audio detection module 100 and may be configured to receive an input of a signal from the audio detection module 100. The semiconductor chip 200 may be configured to amplify and output the signal received from the audio detection module 100. The semiconductor chip 200 may include an inverting amplifier. The inverting amplifier 410 may include an input terminal 420, a first resistor 440, a second resistor 450, and an output terminal 460.

The input terminal 420 may include a non-inverting input terminal 423 and an inverting input terminal 425. The non-inverting input terminal 423 may be connected to ground. The inverting input terminal 425 may be connected to the audio detection module 100 to receive an input of a capacitance signal from the audio detection module 100. Specifically, the inverting input terminal 425 may be connected to the output pad 153 of the audio detection module 100 and may be configured to receive a capacitance signal through the output pad 153.

The inverting input terminal 425 may be connected to the first resistor 440. One side of the first resistor 440 may be connected to the output pad 153 of the audio detection module 100, and the other side of the first resistor 440 may be connected to the piezoresistive element 140 through the first pad 151. The other side of the first resistor 440 may be connected to the inverting input terminal 425. The second resistor 450 may be connected to the inverting input terminal 425 and the output terminal 460. One side of the second resistor 450 may be connected to the piezoresistive element 140 through the second pad 155, and the other side of the second resistor 450 may be connected to the output terminal 460. The output terminal 460 may be connected to the second resistor 450, and may be configured to amplify and output a capacitance signal and a piezoresistive signal input to the inverting amplifier 410 to an electrical signal.

Figure 5:
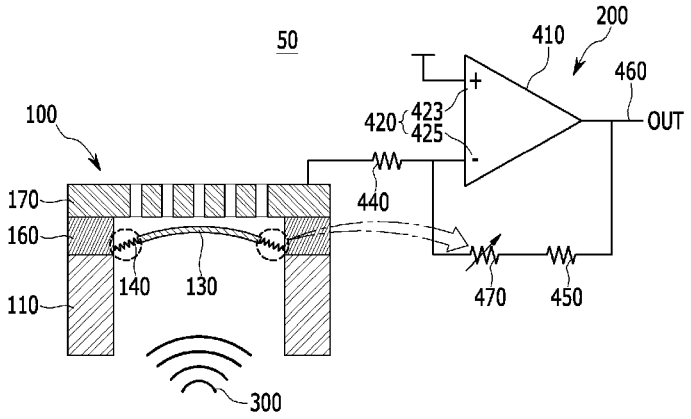
FIG. 5 is an exemplary diagram illustrating a situation in which audio is introduced into a microphone according to another exemplary embodiment of the present invention.

FIG. 5 is an exemplary diagram illustrating a situation in which audio is introduced into a microphone 50 according to another exemplary embodiment of the present invention. Referring to FIG. 5, the audio detection module 100 may be configured to inject audio 300 generated at the exterior, and the vibration film 130 may be configured to vibrate by the audio 300. Accordingly, a gap between the fixed electrode 170 and the vibration film 130 may be changed and a capacitance signal between the vibration film 130 and the fixed electrode 170 may be changed. The capacitance signal may be input to the non-inverting input terminal 423 of the inverting amplifier 410 through the output pad 153.

When a sound pressure is applied by the audio 300 introduced from the exterior, the piezoresistive element 140 of the audio detection module 100 may be configured to generate a piezoresistive signal. The piezoresistive element 140 may be connected to the first resistor 440 through the first pad 151 and may be connected to the second resistor 450 through the second pad 155, thereby exhibiting an effect that it is inserted between the first resistor 440 and the second resistor 450. Further, since a piezoresistive signal may be changed by a sound pressure from the exterior, the piezoresistive element 140 may perform a function of a variable resistor 470.

When using the inverting amplifier 410, an amplifying rate may be determined by the first resistor 440, the second resistor 450, and the piezoresistive element 140. In other words, an amplifying rate may be determined by Equation 2.

$$\text{Gain} = -\frac{R2 + \Delta R}{R1} \qquad \text{Equation 2}$$

wherein, Gain is an amplifying rate, R1 represents a first resistance value, R2 represents a second resistance value, and ΔR represent a piezoresistive signal.

According to an exemplary embodiment of the present invention, while maintaining a hybrid form that may combine a capacitance method and a piezoelectric method for an input sound pressure, sensitivity may be improved. Since the microphone 50 may process a capacitance signal and a piezoresistive signal without an additional circuit, increase of an additional area and power consumption according to an increase in size of the semiconductor chip 200 may be prevented.

While this invention has been described in connection with what is presently considered to be practical exemplary embodiments, it is to be understood that the invention is not limited to the disclosed exemplary embodiments, but, on the contrary, is intended to cover various modifications and equivalent arrangements included within the spirit and scope of the appended claims.

What is claimed is:

1. A microphone, comprising:

an audio detection module having a vibration film configured to output a capacitance signal by vibrating by audio introduced from an exterior and a piezoresistive element configured to output a piezoresistive signal by a sound pressure of the audio; and a semiconductor chip having a single amplifier electrically connected to the audio detection module to receive both the capacitance signal and the piezoresistive signal from the audio detection module and configured to amplify the capacitance signal and the piezoresistive signal to an electrical signal, wherein the single amplifier includes:

an input terminal configured to receive an input of the capacitance signal;

a first resistor connected to the input terminal and connected to the piezoresistive element;

an output terminal configured to amplify and output the capacitance signal and the piezoresistive signal to the electrical signal; and a second resistor connected to the input terminal and the output terminal and connected to the piezoresistive element.

2. The microphone of claim 1, wherein the audio detection module includes:

first and second pads connected to the piezoresistive element; and an output pad configured to output the capacitance signal to the semiconductor chip.

3. The microphone of claim 1, wherein the amplifier is an inverting amplifier or a non-inverting amplifier.

4. The microphone of claim 2, wherein the first pad is connected to the first resistor, and the second pad is connected to the second resistor.

5. The microphone of claim 2, wherein the piezoresistive element is changed based on the sound pressure and is connected to the first and second resistors through the first and second pads.

6. The microphone of claim 2, wherein the input terminal includes:

a non-inverting input terminal connected to the output pad that outputs the capacitance signal; and an inverting input terminal connected to the first and second resistors and the piezoresistive element.

7. The microphone of claim 2, wherein the input terminal includes:

a non-inverting input terminal connected to the ground; and an inverting input terminal connected to an output pad that outputs the capacitance signal, the first and second resistors, and the piezoresistive element.

8. A microphone, comprising:

an audio detection module configured to output a capacitance signal that changes by a vibration film that vibrates by audio introduced from an exterior and a fixed electrode and a piezoresistive signal occurring when a sound pressure is applied to a piezoresistive element by the audio; and a semiconductor chip including a single amplifier configured to receive both the capacitance signal and the piezoresistive signal and amplify the capacitance signal and the piezoresistive signal to an electrical signal, wherein the single amplifier includes:

a non-inverting input terminal configured to receive an input of the capacitance signal;

an inverting input terminal configured to receive an input of the piezoresistive signal connected to first and second resistors; and an output terminal configured to amplify and output the capacitance signal and the piezoresistive signal to the electrical signal.

9. The microphone of claim 8, wherein the amplifier is configured to amplify the capacitance signal and the piezoresistive signal using the piezoresistive element and the first and second resistors.

10. The microphone of claim 8, wherein the audio detection module includes:

a first pad and a second pad connected to the piezoresistive element; and an output pad connected to the non-inverting input terminal and configured to output the capacitance signal to the semiconductor chip.

11. The microphone of claim 10, wherein the first and second resistors are connected to a piezoresistive element through the first and second pads.

12. A microphone, comprising:

an audio detection module including a vibration film configured to output a capacitance signal by vibrating by audio introduced from an exterior and a piezoresistive element configured to output a piezoresistive signal by the audio; and a semiconductor chip including a single amplifier electrically connected to the audio detection module to receive both the capacitance signal and the piezoresistive signal from the audio detection module and configured to amplify the capacitance signal and the piezoresistive signal to an electrical signal, wherein the amplifier comprises: a non-inverting input terminal connected to the ground;

an inverting input terminal configured to receive an input of the capacitance signal;

a first resistor connected to the inverting input terminal and connected to the piezoresistive element; a second resistor connected to the inverting input terminal and connected to the piezoresistive element; and an output terminal connected to the second resistor and configured to amplify and output the capacitance signal to the electrical signal based on the piezoresistive element, the first resistor, and the second resistor.

13. The microphone of claim 12, wherein the audio detection module includes:

a first pad connected to the piezoresistive element and connected to the first resistor;

a second pad connected to the piezoresistive element and connected to the second resistor; and an output pad connected to the inverting input terminal and configured to output the capacitance signal to the inverting input terminal.

* * * * *